US010132506B2

(12) United States Patent
Rentschler

(10) Patent No.: US 10,132,506 B2
(45) Date of Patent: Nov. 20, 2018

(54) COLLECTING HOOD

(71) Applicant: Rentschler Reven GmbH, Sersheim (DE)

(72) Inventor: Sven Rentschler, Sersheim (DE)

(73) Assignee: Rentschler Reven GmbH, Sersheim (DE)

( * ) Notice: Subject to any disclaimer, the term of this patent is extended or adjusted under 35 U.S.C. 154(b) by 466 days.

(21) Appl. No.: 14/834,750

(22) Filed: Aug. 25, 2015

(65) Prior Publication Data

US 2016/0097544 A1 Apr. 7, 2016

Related U.S. Application Data

(63) Continuation of application No. PCT/EP2014/052181, filed on Feb. 5, 2014.

(30) Foreign Application Priority Data

Mar. 27, 2013 (DE) ..... 10 2013 103 124

(51) Int. Cl.
*F24C 15/20* (2006.01)

(52) U.S. Cl.
CPC ..... *F24C 15/2035* (2013.01); *F24C 15/20* (2013.01); *F24C 15/2042* (2013.01)

(58) Field of Classification Search
CPC ... F24C 15/20; F24C 15/2035; F24C 15/2042
See application file for complete search history.

(56) References Cited

U.S. PATENT DOCUMENTS 3,978,777 A * 9/1976 Nett ..... B08B 15/02 126/299 D
4,047,519 A 9/1977 Nett
(Continued)

FOREIGN PATENT DOCUMENTS

DE 2607301 9/1976
DE 8531520 2/1986
(Continued)

OTHER PUBLICATIONS

International Search Report for corresponding application PCT/EP2014/052181 dated Jun. 25, 2014, 3 pages.

*Primary Examiner* — Kenneth Rinehart
*Assistant Examiner* — Logan Jones
(74) *Attorney, Agent, or Firm* — Lipsitz & McAllister, LLC

(57) ABSTRACT

A collecting hood for capturing exhaust air above cooking areas, production devices and the like is provided. The collecting hood includes a vapor chamber, an extraction chamber and an air supply chamber. The vapor chamber is downwardly open and tapers upward. The extraction chamber is separated from the vapor chamber by a filter or a separator. The filter or separator forms an inclined boundary of the upwardly tapering vapor chamber. The air supply chamber tapers downward and merges at its bottom end into a curved deflection region which opens out into a discharge opening which is arranged at a bottom end of the vapor chamber. Supply air, which is blown into the air supply chamber, emerges from the discharge opening horizontally or upwardly at an angle in the direction of the filter or separator. A negative pressure chamber is arranged between the vapor chamber and the air supply chamber.

19 Claims, 3 Drawing Sheets

(56) References Cited

U.S. PATENT DOCUMENTS

| | | | | | |
|---|---|---|---|---|---|
| 4,346,692 | A * | 8/1982 | McCauley | F24F 13/075 | 126/299 D |
| 4,552,059 | A | 11/1985 | Potter | | |
| 4,586,486 | A * | 5/1986 | Kaufman | F24C 15/20 | 126/299 D |
| 4,811,724 | A * | 3/1989 | Aalto | F24C 15/20 | 126/299 D |
| 6,632,132 | B1 * | 10/2003 | Kikuchi | F24C 15/2028 | 126/299 D |

FOREIGN PATENT DOCUMENTS

| | | | | |
|---|---|---|---|---|
| EP | 1094278 | | 4/2001 | |
| FR | 2590813 | | 6/1987 | |
| FR | 2635579 | | 2/1990 | |
| FR | 2746174 | | 9/1997 | |
| FR | 2746174 | A1 * | 9/1997 | F24C 15/20 |
| GB | 1512785 | A * | 6/1978 | F04F 5/46 |

* cited by examiner

COLLECTING HOOD

This application is a continuation of international application number PCT/EP2014/052181 filed on Feb. 5, 2014 and claims the benefit of German application number 10 2013 103 124.2 filed on Mar. 27, 2013, which are incorporated herein by reference in their entirety and for all purposes.

BACKGROUND OF THE INVENTION

The present invention relates to a collecting hood for capturing the exhaust air above cooking areas, production devices and the like, said collecting hood including a vapor chamber, an extraction chamber and an air supply chamber which extend horizontally and parallel to one another in a longitudinal direction, wherein

- the vapor chamber is downwardly open and tapers upward,
- the extraction chamber is separated from the vapor chamber by a filter or a separator, wherein the filter or the separator forms an inclined boundary of the upwardly tapering vapor chamber, and
- the air supply chamber tapers downward and merges at its bottom end into a curved deflection region which opens out into a discharge opening which is arranged at a bottom end of the vapor chamber opposite the extraction chamber such that supply air, which is blown from above into the air supply chamber, emerges from the discharge opening horizontally or upwardly at an angle in the direction of the filter or of the separator.

A collecting hood of this type, as is described, for example, in U.S. Pat. No. 3,978,777, is significantly more efficient when capturing exhaust air than collecting hoods of a more simple design which only have an extraction means. A preferred area of use relates to large kitchens in the catering sector, wherein cooking areas in this context can be any kitchen devices in which capturing the exhaust air is necessary or desirable, that is ovens, grills, roasters, deep fat fryers, etc. In this case, the exhaust air to be captured above all includes water vapor, oil and grease. The use of such collecting hoods, however, is not limited to cooking areas, they can also be used, for example, for capturing exhaust air in the case of production processes of any kind, in particular in the foodstuff industry or even in industrial manufacturing.

The principle of operation of collecting hoods of this type proceeds from the general problem that the range of the suction action of an extraction chamber is relatively limited such that, in the case of collecting hoods which operate exclusively with extraction means, a relatively large proportion of the exhaust air captured in the vapor chamber passes the extraction chamber and the filter or separator and is not immediately extracted. The exhaust air captured in this way stays in the vapor chamber a very long time and rotates inside said vapor chamber in a rolling flux until it is captured by the extraction chamber and extracted. Consequently, a directed air flow, which runs from the discharge opening to the filter or separator and, in so doing, crosses the vapor chamber in which the ascending exhaust air is collected, is generated by means of the air supply chamber. Said air flow captures the exhaust air such that it flows in a very effective manner through the filter or the separator into the extraction chamber and there can be extracted quicker than in the case of the conventional collecting hood without an air supply chamber.

SUMMARY OF THE INVENTION

Said principle functions all the better the more the supply flow can be steered from the horizontal into a direction which extends upwardly at an angle, as with reference to the exhaust air, a flow directed as upwardly as possible is to be effected.

It has been shown, however, that an air flow which is directed to a marked extent upwardly at an angle is hardly able to be realized using the known structural measures, as the air flowing from above into the air supply chamber has to be deflected at an acute angle for this purpose. The curved deflection region can certainly be designed with a corresponding geometry, however, it has been shown in practice that turbulence then occurs and the inner radius of the deflection region is extensively flow-impeding such that the air flow emerging from the discharge opening frequently comprises too small an incline or even falls away slightly.

It is the object of the present invention to develop further a collecting hood of this type such that said problem is able to be eliminated.

Said object is achieved according to the invention in the case of a collecting hood of the type mentioned in the introduction in that the collecting hood additionally includes a negative pressure chamber which is arranged between the vapor chamber and the air supply chamber, wherein the negative pressure chamber is closed on all sides with the exception of a suction opening at its bottom end which opens out in the region of an inner radius of the curved deflection region of the air supply chamber into said deflection region, and wherein the negative pressure chamber and the air supply chamber are separated from one another along an induction region, which connects upwardly to the suction opening or to the deflection region, by a wall which comprises a plurality of individual apertures which are arranged consecutively in the longitudinal direction of the collecting hood.

In this case, the following phenomenon underlies the method of operation of the invention: The supply air which flows through the supply air chamber from top to bottom is accelerated by the tapering structure thereof and passes the wall of the induction region at a relatively fast flow speed. As a result, via the apertures in said wall, negative pressure is induced in the adjoining negative pressure chamber which, in turn, via a suction opening, brings about a suction effect in the deflection region into which the suction opening opens out. Said opening-out is situated on the inner radius, i.e. above the air flow which is deflected into a substantially horizontal direction. Said air flow is therefore 'pulled upward' somewhat on account of the suction opening such that it emerges out of the discharge opening at a more pronounced incline than would be the case without the air supply chamber according to the invention with the induction region and the suction opening.

It has been shown specifically that, with the same geometry of the air supply chamber and of the deflection region, the incline of the emerging air flow is able to be increased by the invention by approximately between 10° and 15°, which already results in a noticeable increase in the efficiency of the collecting hood when the flow direction includes an additional upward component as a result.

Most effectively, the width of the suction opening is between 20% and 50% of the width of the discharge opening. The width refers in each case to the opening width perpendicular to the longitudinal direction of the collecting hood, both the discharge opening and the suction opening extending in the form of a slot along said longitudinal direction. In general, the specifications for the geometry of the collecting hood refer to a view in cross section, in so far as nothing to the contrary is stated explicitly.

The absolute width of the openings is naturally dependent on the dimensioning of the collecting hood, it being possible, in the case of a typical realization, for the discharge opening to have, for example, a width of approximately 5 cm, the width of the suction opening would then be correspondingly within the range of approximately between 1 and 2.5 cm.

The wall between the air supply chamber and the negative pressure chamber in the induction region is oriented in a preferred manner substantially vertically. This also applies to the opposite wall of the air supply chamber which merges further below into the outer radius of the curved deflection region. Consequently, the supply air enters the deflection region in a vertically downward manner.

A wall, which forms an inclined boundary of the downwardly tapering air supply chamber, may connect upwardly to the induction region. The tapering region then ends directly in front of the induction region such that the maximum flow speed of the supply air is achieved there. The inclined boundary wall of the air supply chamber separates said air supply chamber from the negative pressure chamber, which is arranged between the air supply chamber and the vapor chamber.

The individual apertures in the induction region, i.e. in the wall between the negative pressure chamber and the air supply chamber in said region, can have various shapes, wherein the apertures should be optimized with regard to the induction of a negative pressure as a result of the supply air flowing past.

It has proved to be particularly expedient when the individual apertures have a round shape. The apertures, in this case, can have in particular a diameter of between 10 and 20 mm.

In the case of a particularly preferred embodiment of the invention, a flow accelerating element, which is oriented substantially perpendicular to the flow direction of the supply air and comprises a plurality of apertures, is arranged in the air supply chamber above the induction region. As a result, the cross sectional flow of the air supply chamber is reduced and the flow speed in the subsequent induction region is increased, as a result of which the induction of negative pressure in the negative pressure chamber becomes even more effective. The shape of the apertures in the flow accelerating element can be chosen relatively freely in principle, round apertures being provided in the simplest case. A perforated plate can be used, in particular, as a flow accelerating element.

In an expedient manner, the flow accelerating element is oriented substantially perpendicular to the wall in the induction region. Typically, the flow accelerating element is arranged horizontally and the wall in the induction region is arranged vertically.

It is favorable when the curved deflection region in the region of its outer radius comprises a rounded wall which ends at the discharge opening with an incline which is at least as large as the desired incline of the air flow emerging from the discharge opening. Such geometry of the deflection region is not sufficient, as described above, in order to actually achieve the desired incline of the air flow, however it can support the effect of the suction opening according to the invention.

In a preferred manner the collecting hood additionally includes a supply air blower by means of which the supply air can be blown from above into the air supply chamber. The supply air blower, in this case, can be arranged at the top end of the air supply chamber or can be connected further upstream by means of a corresponding supply line. It is also conceivable in the case of large systems for several collecting hoods to be supplied by one supply air blower.

In a favorable manner, the supply air blown into the air supply chamber is supplied from outside the area in which the collecting hood is installed. In particular, in this case, this is untempered outside air as this is energetically more favorable to use than the room air which has been heated or cooled depending on the time of year, and which is removed at least in part via the extraction chamber and is output to the outside.

A throttle valve can be arranged in the upper region of the air supply chamber in order to be able to restrict the amount of air supplied. Such restriction can be carried out corresponding to the extraction performance of the collecting hood that is necessary in each case.

In a further preferred manner, the collecting hood additionally includes a suction fan by means of which the exhaust air can be drawn from above out of the extraction chamber. As a rule, the drawn-off exhaust air can be output into the surrounding area, since oils and grease, which are typically included in the exhaust air in the form of fine droplets, as well as, where applicable, solid particles, have been removed extensively by the filter or the separator. Materials with a rather fine-pored structure (e.g. metal fabric or steel wool) are designated as filters, whereas elements with a defined geometry which enable a defined separation in particular of oil and grease droplets from the exhaust air flow are designated as separators. Suitable filters and separators for collecting hoods are known from the prior art.

As has already been mentioned, the vapor chamber is downwardly open toward the cooking area and is tapered upward. The boundary of the vapor chamber can be in particular substantially triangular or trapezoidal in cross section. A lighting device can be provided at the top, closed end of the vapor chamber, in particular in the case of a trapezoidal form.

The boundary of the vapor chamber toward the extraction chamber is formed by the filter or the separator. The filter or the separator is preferably inclined by an angle of between 40° and 70° in relation to the horizontal.

The inclined boundary of the vapor chamber located opposite the filter or the separator is formed in a preferred manner by a wall which separates the vapor chamber from the negative pressure chamber. Said wall, as also the majority of other component parts of the collecting hood, can be formed from a sheet of stainless steel.

In the case of a preferred embodiment, the wall between the vapor chamber and the negative pressure chamber includes a top portion with a more pronounced inclination and a bottom portion with a less pronounced inclination wherein the latter corresponds substantially to the desired incline of the air flow emerging from the discharge opening. Said wall portion consequently serves as a directing element for the emerging air flow. In this case, it is preferred when the bottom portion of the wall is inclined by an angle of between 15° and 30° in relation to the horizontal.

The top portion of the wall between the vapor chamber and the negative pressure chamber (when divided into two portions) or the wall as a whole (where the inclination is uniform) is inclined in a favorable manner by an angle of between 40° and 70° in relation to the horizontal, that is corresponding to the preferred inclination of the filter or of the separator. As a result of said steeper angle compared to the bottom portion of the wall (if such a one is provided), the vapor chamber is enlarged and the negative pressure chamber reduced, which, as a rule, is advantageous.

BRIEF DESCRIPTION OF THE DRAWINGS

These and further advantages of the invention are explained in more detail by way of the following exemplary embodiment with reference to the Figures, in which, in detail.

DETAILED DESCRIPTION

Figure 1:
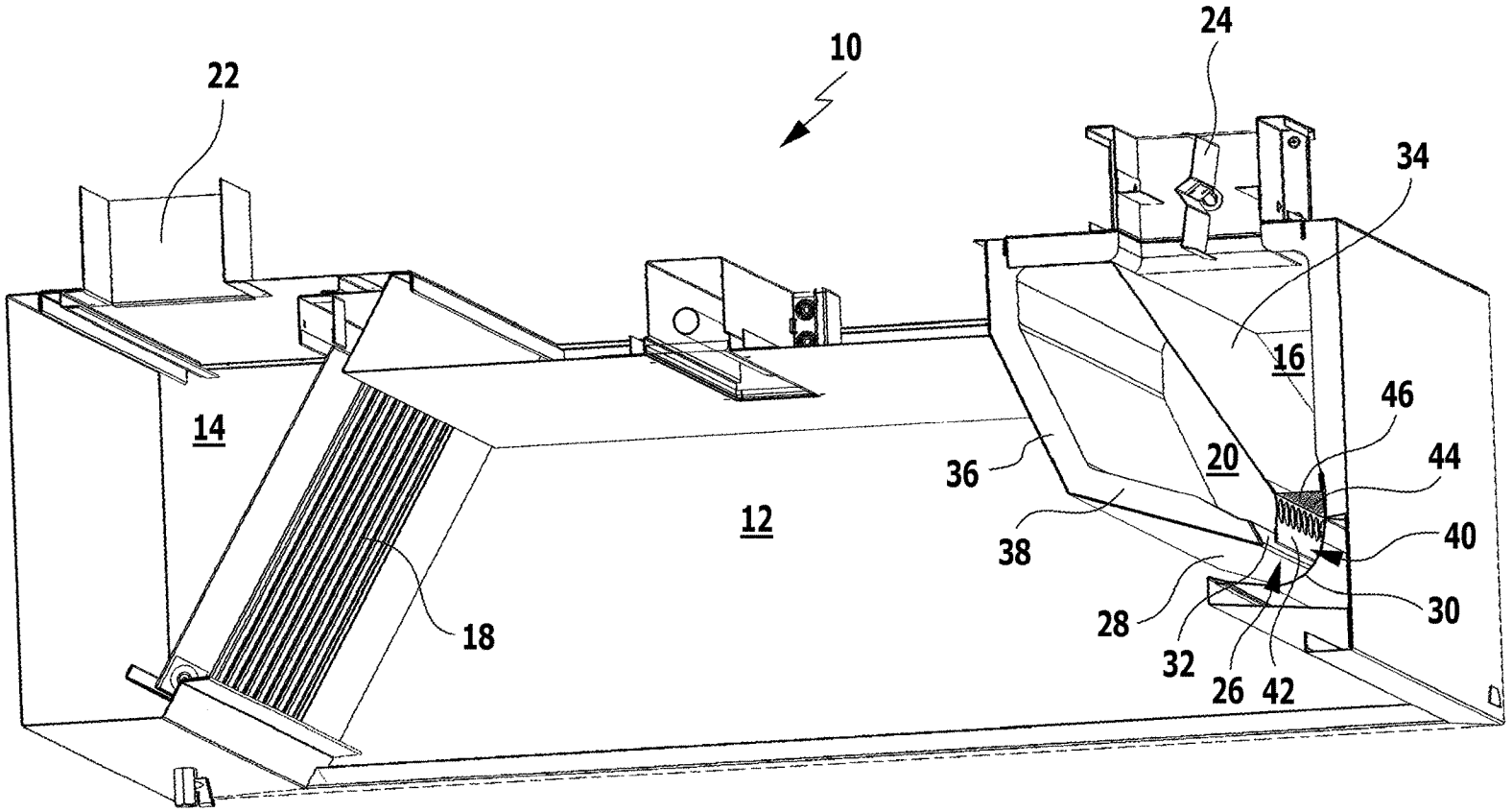
FIG. 1 shows a perspective representation of a collecting hood according to the invention.

FIG. 1 shows a perspective representation of an exemplary embodiment of a collecting hood according to the invention which is designated as a whole by the reference 10. The collecting hood 10 extends in a longitudinal direction which extends almost perpendicular to the drawing plane. For better clarity, only a portion of the collecting hood 10 is shown in FIG. 1.

The collecting hood 10 includes a centrally arranged vapor chamber 12 which is downwardly open and tapers upward. An extraction chamber 14 and an air supply chamber 16 are arranged on either side of the vapor chamber 12, the extraction chamber 14 being separated from the vapor chamber 12 by a separator 18 and a negative pressure chamber 20 being arranged between the vapor chamber 12 and the air supply chamber 16. The vapor chamber 12, extraction chamber 14, air supply chamber 16 and negative pressure chamber 20 extend horizontally and parallel to one another in the longitudinal direction.

The collecting hood 10 is installed above a cooking area and other devices where exhaust air to be captured is formed, the exhaust air ascending into the vapor chamber 12. From there, it passes through the separator 18 into the extraction chamber 14 and is removed by means of an extraction blower, which is not shown in the Figure, through the extraction opening 22 which is arranged at the top end of the extraction chamber 14. The separator 18 removes contaminants, in particular droplets of oil and grease, as well as, where applicable, solid particles, from the exhaust air which fall in the direction of the bottom end of the extraction chamber 14 and collect there.

Supply air, this being in particular untempered outside air, is blown into the air supply chamber 16 from above by means of a supply air blower. A throttle valve 24 is arranged at the top end of the air supply chamber for regulating the volume of supplied air. The supply air flows downward in the air supply chamber 16, it being accelerated by the tapering form.

The air supply chamber 16 merges at its bottom end into a curved deflection region 26 which finally opens out into a discharge opening 28. In the region of its outer radius, the deflection region 26 comprises a rounded wall 30 which ends with a positive incline at the discharge opening 28. The air flow emerging from the discharge opening crosses the vapor chamber 12 in the direction of the separator 18, as a result of which the capturing of the exhaust air which ascends from below and its passage into the extraction chamber 14 is considerably improved.

The negative pressure chamber 20 of the aperture hood 10 according to the invention is closed on all sides (the end-face boundaries of all the chambers are not shown in FIG. 1), with the exception of a suction opening 32 which opens out into the curved deflection region 26 in the region of its inner radius. The negative pressure chamber 20 is separated from the air supply chamber 16 by a wall 34 which forms an inclined boundary of the tapering air supply chamber 16. The wall between the negative pressure chamber 20 and the vapor chamber 12 includes a top portion 36 and a bottom portion 38, the bottom portion 38 comprising a lesser inclination (with reference to the horizontal) which corresponds substantially to the desired incline of the airflow emerging from the discharge opening 28.

The incline of the air flow leaving the discharge opening 28 is increased by the features of the collecting hood 10 according to the invention by the air flow in the deflection region 26 being "pulled upward" in the direction of the suction opening 32 as a result of the negative pressure in the negative pressure chamber 20. Said negative pressure is generated as a result of an induction region 40, the negative pressure chamber 20 and the air supply chamber 16 being separated from one another along said induction region 40 by a wall 42 which comprises a plurality of individual apertures 44 which are arranged consecutively in the longitudinal direction of the collecting hood and have a round shape. The induction region 40 is arranged directly above the deflection region 26 and below the tapering region of the air supply chamber 16 such that the flow speed of the supply air is at its fastest in the induction region 40.

The flow speed of the supply air in the induction region 40 is additionally strengthened by a flow accelerating element 46 which is arranged above the induction region 40. The flow accelerating element 46 comprises a plurality of apertures, in this example this being a perforated plate. In this case, the flow accelerating element is oriented horizontally and the wall 42 in the induction region 40 vertically.

Figure 2:
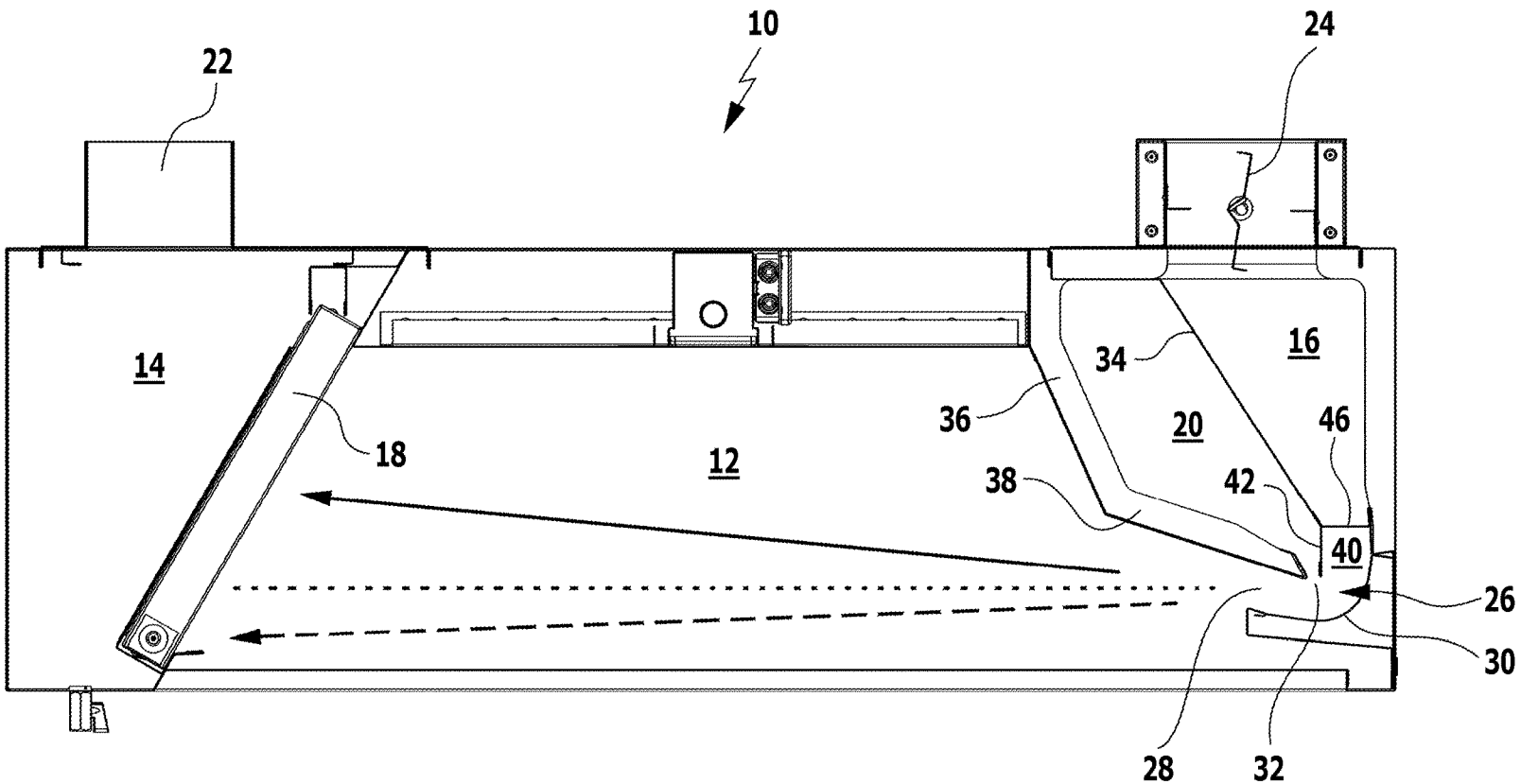
FIG. 2 shows a cross sectional representation of the collecting hood according to FIG. 1.

FIG. 2 shows a cross sectional representation of the collecting hood according to FIG. 1. The direction of the air flow emerging from the discharge opening 28, which is achieved in the case of the exemplary embodiment shown, is shown by a continuous arrow. The air flow runs upward at an angle at an incline of approximately 6° in relation to the horizontal (dotted line), and very effective capturing of the exhaust air is achieved as a result of said upward component of the flow. In contrast, a broken arrow indicates the direction of the air flow which would be achieved with a corresponding collecting hood without the features according to the invention, i.e. if, for example, the suction opening 32 and the apertures 44 in the wall 42 of the induction region 40 were closed. In this case, the air flow would even fall away slightly in relation to the horizontal.

Figure 3:
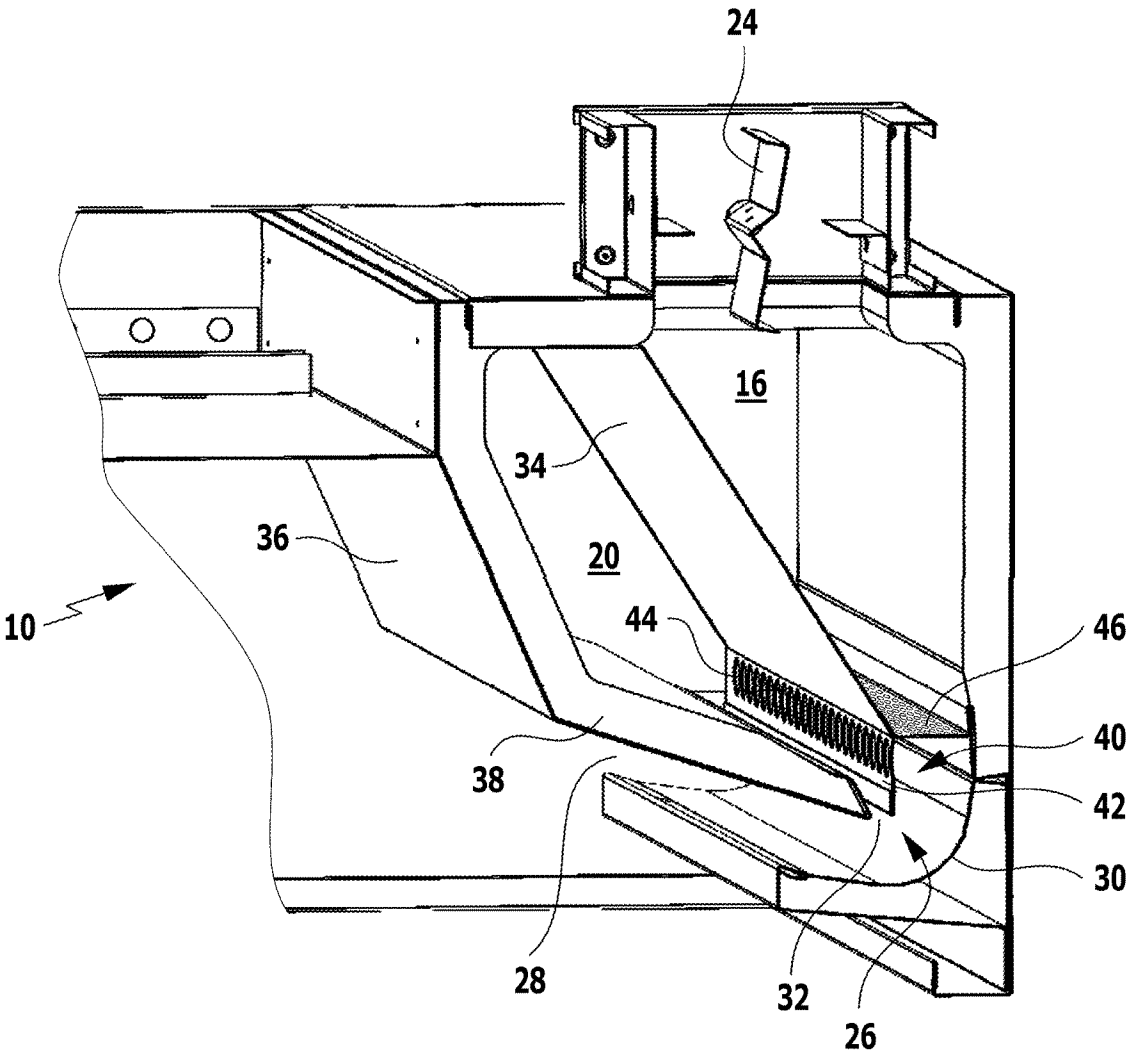
FIG. 3 shows a perspective representation of part of the collecting hood according to FIG. 1.

FIG. 3 shows part of the collecting hood 10 from a different perspective, it in particular being easier to see the configuration of the induction region 40 and of the suction opening 32. The suction opening 32, in the case of said exemplary embodiment, comprises a width of approximately 2 cm, the width of the discharge opening 28 being approximately 6 cm. The apertures 44 in the wall 42 of the induction region 40 have in each case a diameter of approximately 15 mm. The apertures in the flow accelerating element 46 have a diameter of approximately 5 mm. It is obvious that said measurements are given simply as an example and can be correspondingly adapted in dependence on the dimensioning and shaping of the collecting hood.

LIST OF REFERENCES

10 Collecting hood
12 Vapor chamber

14 Extraction chamber
16 Air supply chamber
18 Separator
20 Negative pressure chamber
22 Extraction opening
24 Throttle valve
26 Deflection region
28 Discharge opening
30 Rounded wall of 26
32 Suction opening
34 Wall
36 Top portion
38 Bottom portion
40 Induction region
42 Wall of 40
44 Apertures of 42
46 Flow accelerating element

What is claimed is:

1. A collecting hood for capturing the exhaust air above cooking areas, production devices and the like, said collecting hood comprising a vapor chamber, an extraction chamber and an air supply chamber which extend horizontally and parallel to one another in a longitudinal direction, wherein:

the vapor chamber is downwardly open and tapers upward, the extraction chamber is separated from the vapor chamber by a filter or a separator, wherein the filter or the separator forms an inclined boundary of the upwardly tapering vapor chamber, and the air supply chamber tapers downward and merges at its bottom end into a curved deflection region which opens out into a discharge opening which is arranged at a bottom end of the vapor chamber opposite the extraction chamber such that supply air which is blown from above into the air supply chamber, emerges from the discharge opening horizontally or upwardly at an angle in the direction of the filter or of the separator, and further comprising a negative pressure chamber which is arranged between the vapor chamber and the air supply chamber, wherein the negative pressure chamber is closed on all sides with the exception of a suction opening at its bottom end which opens out in the region of an inner radius of the curved deflection region of the air supply chamber into said deflection region, and wherein the negative pressure chamber and the air supply chamber are separated from one another along an induction region, which connects upwardly to the suction opening or to the deflection region, by a wall which comprises a plurality of individual apertures which are arranged consecutively in the longitudinal direction of the collecting hood.

2. The collecting hood as claimed in claim 1, wherein the width of the suction opening is between 20% and 50% of the width of the discharge opening.

3. The collecting hood as claimed in claim 1, wherein the wall in the induction region is oriented substantially vertically.

4. The collecting hood as claimed in claim 1, wherein a wall, which forms an inclined boundary of the downwardly tapering air supply chamber, connects upwardly to the induction region.

5. The collecting hood as claimed in claim 1, wherein the individual apertures in the induction region have a round shape.

6. The collecting hood as claimed in claim 5, wherein the individual apertures have a diameter of between 10 and 20 mm.

7. The collecting hood as claimed in claim 1, wherein a flow accelerating element, which is oriented substantially perpendicular to the flow direction of the supply air and comprises a plurality of apertures, is arranged in the air supply chamber above the induction region.

8. The collecting hood as claimed in claim 7, wherein the flow accelerating element is oriented substantially perpendicular to the wall in the induction region.

9. The collecting hood as claimed in claim 1, wherein in the region of its outer radius the curved deflection region comprises a rounded wall which ends at the discharge opening with an incline which is at least as large as the desired incline of the air flow emerging from the discharge opening.

10. The collecting hood as claimed in claim 1, additionally comprising a supply air blower by means of which the supply air can be blown from above into the air supply chamber.

11. The collecting hood as claimed in claim 1, wherein the supply air blown into the air supply chamber is supplied from outside the area in which the collecting hood is installed.

12. The collecting hood as claimed in claim 1, wherein a throttle valve is arranged in the upper region of the air supply chamber in order to be able to restrict the amount of air supplied.

13. The collecting hood as claimed in claim 1, additionally including a suction fan by means of which the exhaust air can be drawn from above out of the extraction chamber.

14. The collecting hood as claimed in claim 1, wherein the boundary of the vapor chamber is substantially triangular or trapezoidal in cross section.

15. The collecting hood as claimed in claim 1, wherein the filter or the separator is inclined by an angle of between 40° and 70° in relation to the horizontal.

16. The collecting hood as claimed in claim 1, wherein the vapor chamber is separated from the negative pressure chamber by a wall which forms an inclined boundary of the vapor chamber which is located opposite the filter or the separator.

17. The collecting hood as claimed in claim 16, wherein the wall between the vapor chamber and the negative pressure chamber includes a top portion with a more pronounced inclination and a bottom portion with a less pronounced inclination, wherein the latter corresponds substantially to the desired incline of the air flow emerging from the discharge opening.

18. The collecting hood as claimed in claim 17, wherein the bottom portion of the wall between the vapor chamber and the negative pressure chamber is inclined at an angle of between 15° and 30° in relation to the horizontal.

19. The collecting hood as claimed in claim 16, wherein the wall between the vapor chamber and the negative pressure chamber or the top portion of said wall is inclined by an angle of between 40° and 70° in relation to the horizontal.

* * * * *